US010492551B1

(12) United States Patent
Kereiakes et al.

(10) Patent No.: US 10,492,551 B1
(45) Date of Patent: Dec. 3, 2019

(54) ANGLED ARRAY OF AIRFLOW CHANNELS

(71) Applicants: Evan Kereiakes, New York, NY (US); Christopher Hamman, Sturbridge, MA (US)

(72) Inventors: Evan Kereiakes, New York, NY (US); Christopher Hamman, Sturbridge, MA (US)

( * ) Notice: Subject to any disclaimer, the term of this patent is extended or adjusted under 35 U.S.C. 154(b) by 0 days.

(21) Appl. No.: 15/368,207

(22) Filed: Dec. 2, 2016

Related U.S. Application Data

(60) Provisional application No. 62/262,817, filed on Dec. 3, 2015.

(51) Int. Cl.
*A42B 1/06* (2006.01)
*A42C 5/04* (2006.01)

(52) U.S. Cl.
CPC ..... *A42B 1/062* (2013.01); *A42C 5/04* (2013.01)

(58) Field of Classification Search
CPC ..... A42B 1/062; A42B 1/063; A42B 1/18; A42B 1/008; A42B 1/064; A42B 1/061; A42B 1/12; A42B 3/0493; A42B 3/28; A42B 3/281; A42B 3/283; A42C 5/04
USPC .... 2/195.1, 195.7, 200.1; D2/872, 893, 876, D2/882, 891
See application file for complete search history.

(56) References Cited

U.S. PATENT DOCUMENTS 2,874,387 A * 2/1959 Bannister ..... A42B 1/062 2/10
3,927,421 A * 12/1975 Simon ..... A42B 3/0493 2/12
D246,272 S * 11/1977 Bay ..... D2/893
4,292,689 A 10/1981 Townsend, Jr.
4,945,575 A * 8/1990 Townsend ..... A61F 9/045 2/12
5,487,191 A * 1/1996 Ridley ..... A42B 1/062 2/10
5,781,933 A * 7/1998 De Giacomi ..... A61F 9/045 2/195.1
D440,382 S * 4/2001 Scheinbaum ..... D2/882
7,082,618 B1 * 8/2006 Muso ..... A42B 1/062 2/175.1
7,398,560 B1 * 7/2008 Swensen ..... A42C 5/04 2/182.2
D592,835 S * 5/2009 Wilson ..... A42C 5/04 D2/893
D601,329 S * 10/2009 Johns ..... D2/876
8,782,815 B2 * 7/2014 Greene, Jr. ..... A42B 1/062 2/171.3
2007/0061937 A1 * 3/2007 Curle ..... A42B 1/062 2/12
2014/0137311 A1 * 5/2014 Sandoval ..... A42B 1/063 2/181

(Continued)

*Primary Examiner* — Amy Vanatta
(74) *Attorney, Agent, or Firm* — Fish & Richardson P.C.

(57) ABSTRACT

Among other things, we describe an apparatus comprising a head covering configured to be worn on a head of a wearer; and a bill attached to the head covering, the bill comprising an angled array of air flow channels configured to enable air flow originating from a direction in front or to the side of the wearer enters into the channels from the bottom of the bill and then is deflected upward so it continues traveling inside the channels through the bill until the air exits from the channels when the air reaches the top of the hat bill.

20 Claims, 6 Drawing Sheets

(56) References Cited

U.S. PATENT DOCUMENTS

2016/0366966 A1* 12/2016 Sunness ..... A42B 1/004
2017/0215513 A1* 8/2017 Crunk ..... A42C 5/04

* cited by examiner

ANGLED ARRAY OF AIRFLOW CHANNELS

BACKGROUND

People engaged in the outdoors often wear hats or use a protective screen with a solid visor to shield their face or body from being exposed to direct sunshine. While effective at blocking sunshine, the construction of most hats or shade devices involves affixing the solid visor in a manner which catches or disrupts the natural flow of air around the hat or device. Interrupted air flow under the visor can create enough upward pressure to lift the hat from the person's head or cause damage to the screen. In addition, if the hat is lifted off and falls into the water it often sinks quickly.

SUMMARY

Among other things, we describe an apparatus comprising a head covering configured to be worn on a head of a wearer; and a bill attached to the head covering, the bill comprising an angled array of air flow channels configured to enable air flow originating from a direction in front or to the side of the wearer enters into the channels from the bottom of the bill and then is deflected upward so it continues traveling inside the channels through the bill until the air exits from the channels when the air reaches the top of the hat bill.

Implementations may have one or more of the following advantages. A windproof hat can provide sun protection and flotation. Wind passes through the hat bill or brim, such that the person's face is completely shielded from direct sunshine, the hat bill is structurally rigid, and that the hat floats in the event it falls into the water.

The hat brim can be curved, rather than, for example, substantially horizontal. The curved brim eliminates sunshine from a relatively large range of angles. An array of channels can be angled in a way that it substantially eliminates sunshine from hitting the face. A multitude of small angled openings that substantially cover the entire portion of a hat bill can be arranged in an organized and methodical pattern. A portion of a hat brim, e.g., that rests against the forehead, can include air flow channels that are intentionally covered so that rain and sun does not pass through. An air foil can be included on the leading edge of the hat brim. Floating can be achieved by covering air channels to trap air pockets and/or using a floating material (i.e. low density rubberized plastic or foam).

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

People engaged in the outdoors often wear hats or use a protective screen with a solid visor to shield their face or body from being exposed to direct sunshine. While effective at blocking sunshine, the construction of most hats or shade devices involves affixing the solid visor in a manner which catches or disrupts the natural flow of air around the hat or device. Interrupted air flow under the visor can create enough upward pressure to lift the hat from the person's head or cause damage to the screen. In addition, if the hat is lifted off and falls into the water it often sinks quickly.

The apparatus or hat visor described here includes a molded array of angled air flow channels designed to allow air to pass through from underneath while simultaneously protecting the user or wearer from direct sunlight. The design also allows the hat to float in the water, making it practical for aquatic pursuits.

The examples described here pertain to the type of hat commonly referred to as a 'baseball hat', 'baseball cap', 'sports hat', or 'sports cap' among other names. However, the fundamental elements of the design can apply for a variety of other uses such as other types of hats, baby carriages, umbrellas, or any hood, cover, or screen intended to provide shade from the sun.

The techniques described here provide a balance of windproof sun protection and flotation, where applicable. A molded array of angled air flow channels is designed to allow air to pass through from underneath while simultaneously protecting the wearer from direct sunlight. The air flow channels are spread out across the hat visor in a manner, pattern, and angle most optimal for facilitating the flow of air through the hat bill (sometimes called a brim or hat brim) while blocking sunlight from passing through when shining at many or all angles, e.g., an angle perpendicular to the hat bill. The design described here also takes into account ergonomics and aesthetics.

The design can include a molded array of angled air flow channels integrated into the apparatus, visor or hat bill. The hat bill or visor is then fastened onto the apparatus in a typical fashion. For a hat, this means the bill portion is sewn onto the cap portion.

Figure 1:
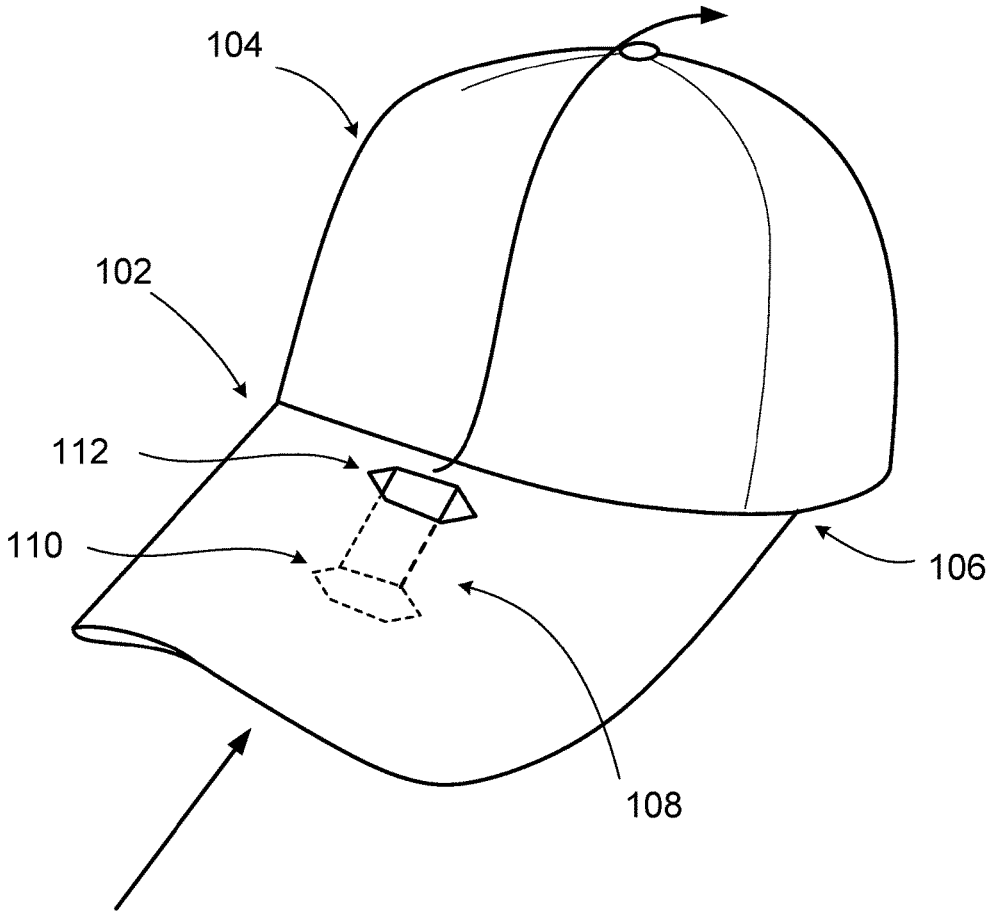
FIGS. 1-5 are views of a hat.

FIG. 1 is an image of the entire hat with a single air flow pocket to demonstrate one of the core functions. Label 102 points to the hat bill, 104 points to the cap portion of the hat (e.g., a head covering), 106 shows where the bill and cap are joined in typical fashion, 108 is the single angled air flow channel, 110 is the bottom of the channel where the air enters below the brim, 112 is the top of the channel where the air exits above the brim and is free to travel over the cap.

Figure 2:
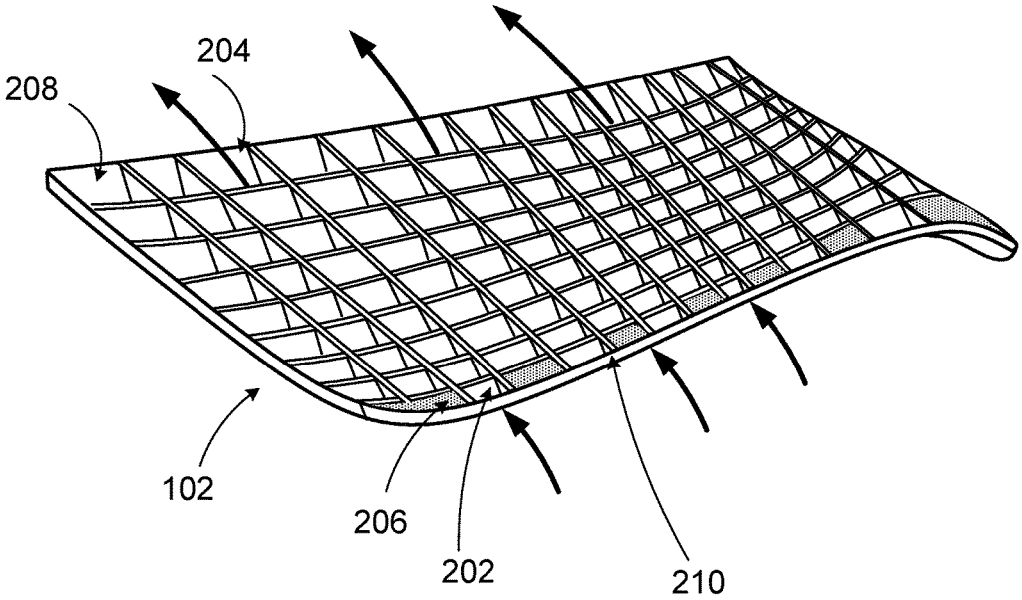

FIG. 2 is a more detailed picture of the bill and air channels from an angled/front view. Label 102 points to the hat bill, in which the air enters through the air pocket 202 at the bottom of the hat bill, the air exits through the air flow channel 204 at the top of the hat bill. The air flow can pass through any of the air flow channels 202 and 204 in the array. Label 206 points to a sealed air flow chamber at the front of the bill which helps the hat to float. The sealed chambers can be positioned anywhere along the hat bill. The arrow for 208 points to one of the angled air flow channels. As shown in the figure, an array of channels includes at least 100 or more of the channels. In some examples, each of the channels is approximately the same size. In some examples, each of the channels is capable of producing approximately the same angle of air flow relative to one another. In some implementations, the bill includes an air foil 210 on the leading edge of the brim that creates downward pressure on the brim when air passes over it. In these examples, the downward pressure keeps the hat in place on the wearer's head.

Figure 3:
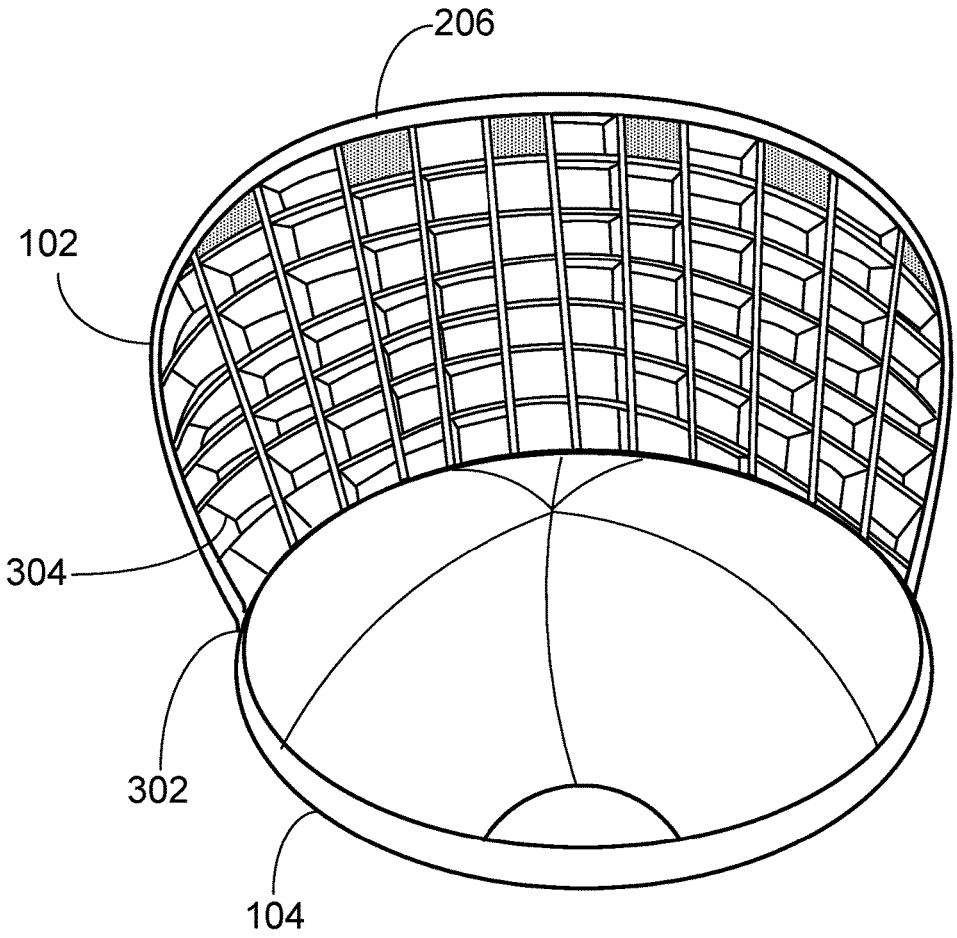

FIG. 3 is a front view of the hat cap and bill from below. Label 102 is the hat bill, 302 where the bill 102 and cap 104 are connected, 104 is the hat cap, 206 is a sealed air flow chamber, 304 is an open air flow chamber.

Figure 4:
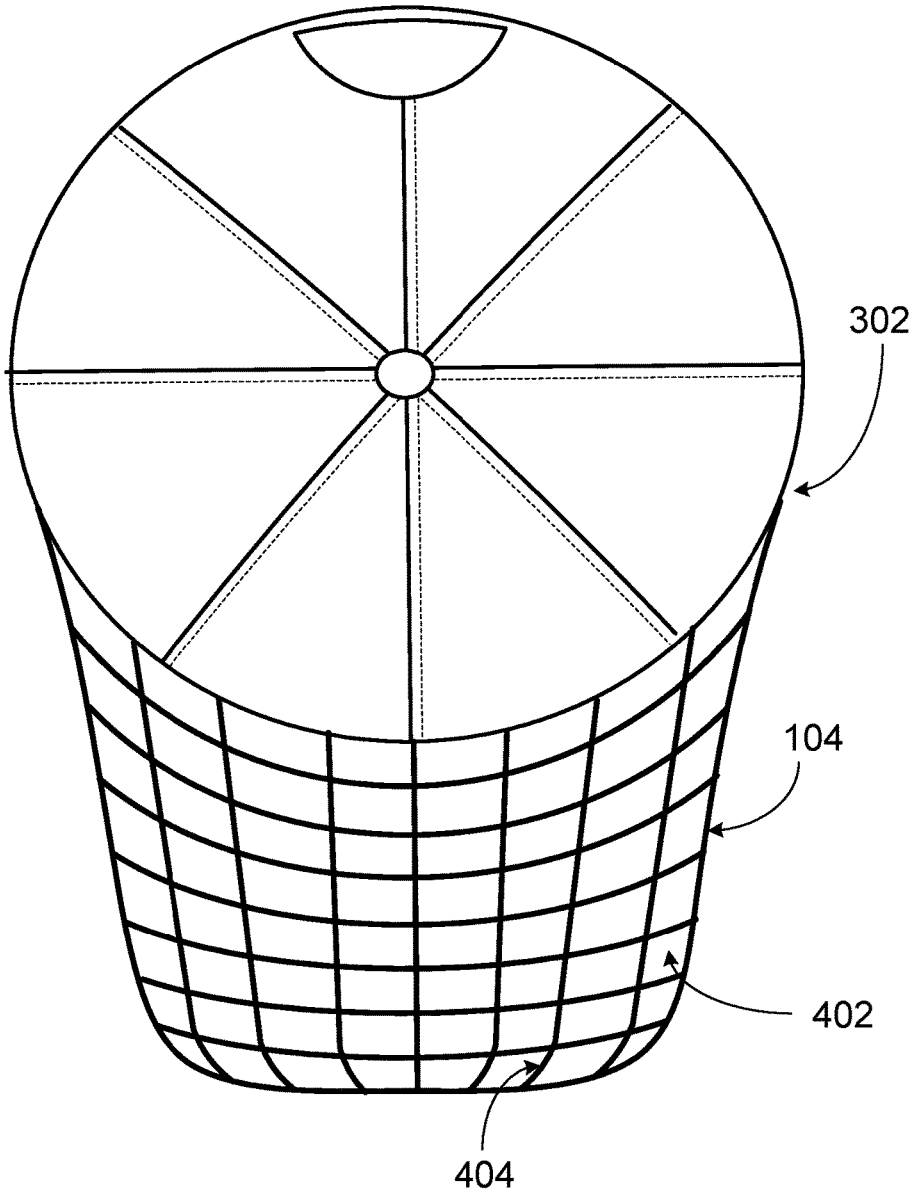

FIG. 4 is a top view of the hat cap and bill. Label 104 is the cap, 402 points to an open air flow channel, 404 is the network of adjacent air flow channels in this example, 302 is where the hat cap and bill connect.

Figure 5:
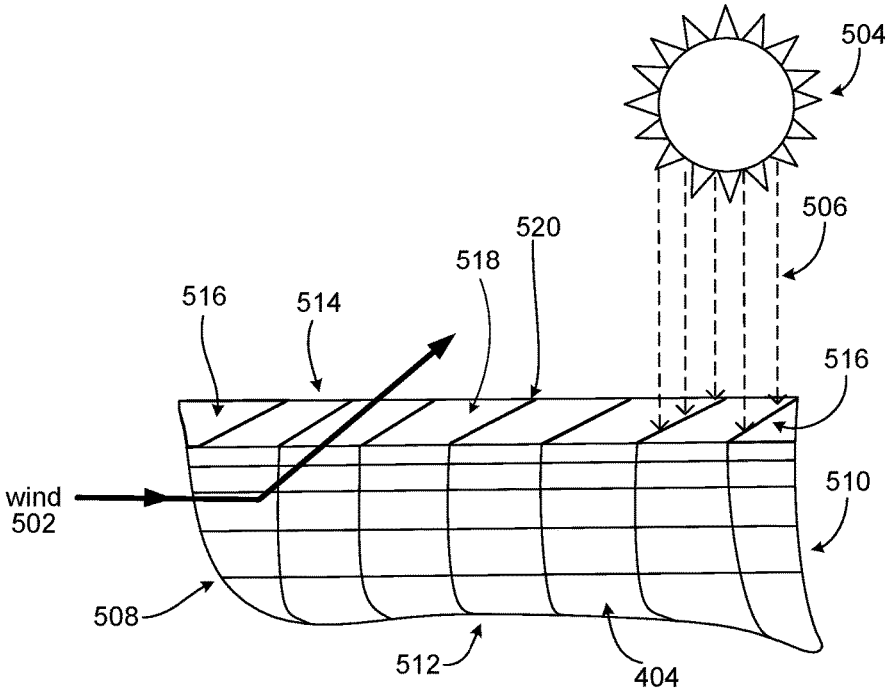

FIG. 5 is a side cutaway of the hat bill showing the inside of the air channels. Label 502 identifies the wind and direction, 504 is the sun, 506 are the sunlight rays which do not penetrate the hat bill when shining from many or all angles, e.g., a perpendicular angle, 508 is the front of the bill, 510 is the back of the hat bill, 512 is the bottom outward edge of the hat bill, 514 is the top of the hat bill at its apex, 516 shows the sealed air flow chambers, 518 identifies the empty space between the air flow walls through which the air is directed, 520 is one wall which comprises the air flow channel and forms part of the network of adjacent air flow channels 404.

Figure 6:
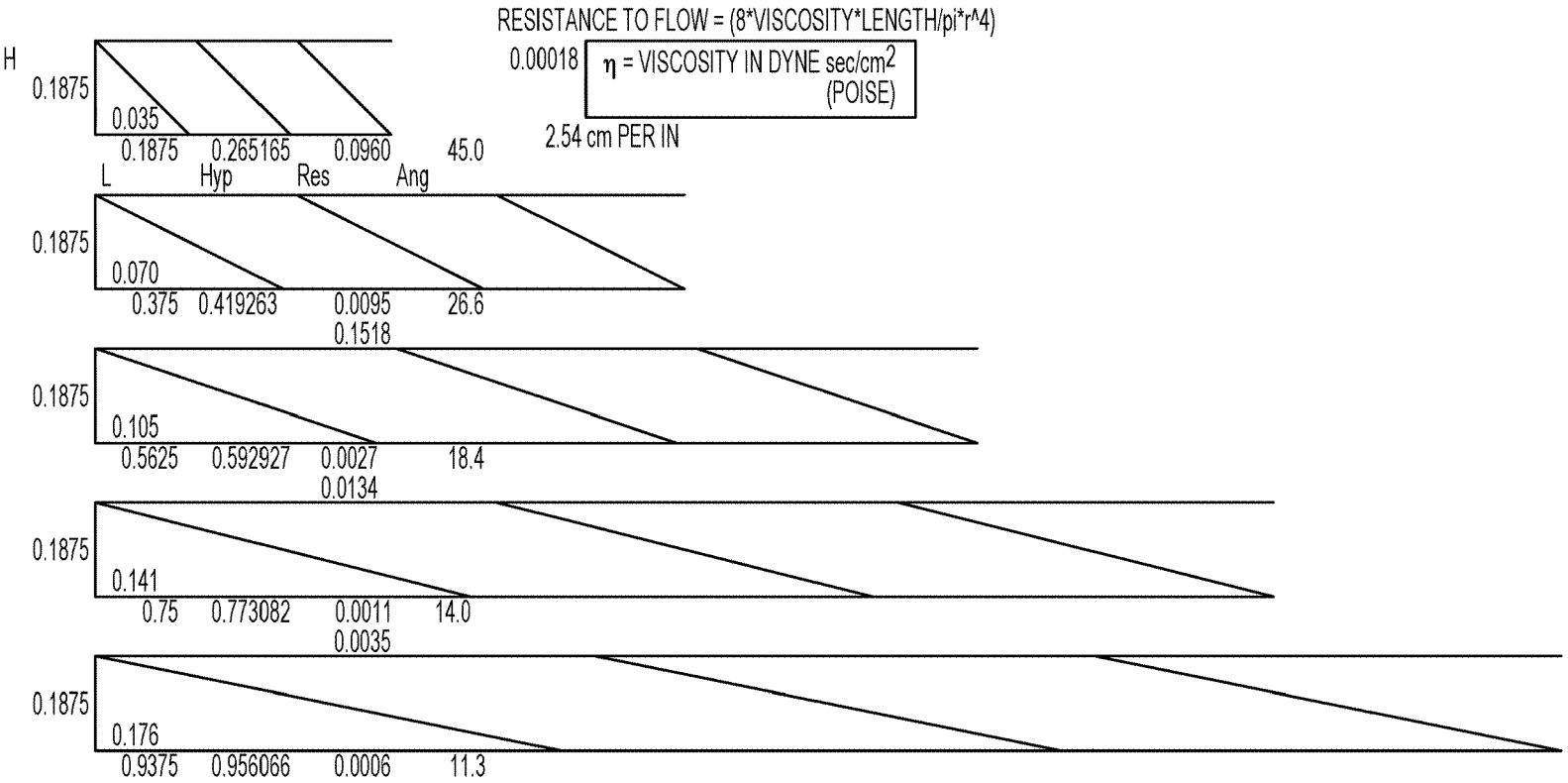
FIG. 6 shows possible air flow channel array deflection angles.

FIG. 6 shows possible air flow channel array deflection angles based on invention specifications described earlier and wind resistance calculations.

The angled array of air flow channels is placed so that air flow originating from a direction in front or to the side of the wearer enters into the channels from the bottom of the hat bill and then is deflected upward so it continues traveling inside the channels through the hat bill until it exits from the channels when it reaches the top of the hat bill. The air flow exiting the top of the hat bill is generally assumed to be flowing in a similar direction as when it entered the bottom of the hat bill, but it could be deflected from its original trajectory by up to approximately 45 degrees. Thus air is channeled through the hat bill, entering from below and exiting at the top, so the air ultimately flows over the top of the wearer's head rather than remain trapped under the hat bill. Because the air flow channels are angled and arranged in the manner described above, they will also block direct sunshine from hitting the wearer's face or body.

Modifications can be made to the angled array of air flow channels such that when the modified design is incorporated into a hat bill, it gives the hat bill buoyancy, enabling it to float in water. Specifically, the key modification consists of permanently sealing off both the bottom and top of a fraction of the air flow channels in order to trap air inside, rather than allow air to pass through. These sealed air flow channels are transformed into air pockets such that the air remains inside and is not capable of passing through the sealed barrier. The optimal ratio of sealed to non-sealed air channels depends on the resulting buoyancy of the hat bill.

The standard or modified hat bill described above is attached to the hat in the same manner that a typical hat bill would be attached to the hat. This method varies according to the style of hat, but generally involves sewing or glue.

To make a hat apparatus out of plastic, the array of air flow channels is designed on a computer and then manufactured using 3-D printing or injection molding. If the array is integrated into another part of the apparatus, it can be glued or sewn into place by a person or machine.

The wearer can choose if they want the design that incorporates sealed air flow chambers should they desire for the invention to also float in water.

The air flow channels can be arranged and spread out across the hat visor in a manner, pattern, and angle most optimal for facilitating the flow of air through the hat bill while blocking sunlight from passing through.

There is no standard shape; instead, the apparatus can emulate the dimensions and shape of the brim on almost any style of hat. The underlying properties described earlier are preserved across all dimensions. The apparatus can be made if a variety of solid materials, though plastic is a common material. In some implementations, some or all of the hat components can be formed of a buoyant material, e.g., foam that floats in water.

People engaged in the outdoors can wear hats or use a protective screen with the array of angled air flow channels integrated into the solid visor to shield their face or body from being exposed to direct sunshine while also protecting the apparatus from loss or damage due to excessive wind. An example of a practical application could be wearing a hat outfitted with the angled air flow channels during a sailing outing on a sunny and windy day. The modified hat described here has a much reduced risk of being blown off the user's head into the water than a normal hat. In addition, the modified hat will float in the event it is blown overboard, allowing the user to more easily retrieve the hat.

The fundamental elements of the design can apply for a variety of other uses such as other types of hats, baby carriages, umbrellas, or any hood, cover, or screen intended to provide shade from the sun. In general, the design can be used to produce all-purpose, all-conditions head gear.

What is claimed is:

1. An apparatus comprising:

a head covering configured to be worn on a head of a wearer; and a bill attached to the head covering, wherein the bill has a transversal curvature, the bill comprising an angled-array of air flow channels with a varying geometry relative to a mediator of the transversal curvature that is configured to enable air that is flowing from a direction in front or to the side of the head covering to enter into the channels from a bottom of the bill at a first angle relative to a longitudinal axis of the bill and be deflected upward so that the air continues traveling inside the channels through the bill at a second angle relative to the longitudinal axis of the bill until the air exits from the channels at a top of the bill, wherein each of the air flow channels is arranged at a fixed angle relative to the bill to prevent direct light, which is shining onto the top of the bill at a perpendicular angle relative to the bill, from passing through the bill and shining onto the wearer.

2. The apparatus of claim 1, comprising a buoyant material in a quantity sufficient for the bill to float in water.

3. The apparatus of claim 1, comprising foam.

4. The apparatus of claim 1, comprising low-density rubberized plastic.

5. The apparatus of claim 1, comprising a sealed air pocket.

6. The apparatus of claim 1, wherein the bill is curved at a curvature matching curvature of the head covering.

7. The apparatus of claim 1 comprising a baseball cap.

8. The apparatus of claim 1, wherein one or more of the air flow channels are configured to deflect air from its original trajectory by approximately 45 degrees.

9. The apparatus of claim 1, wherein the bill is sewn to the head covering.

10. The apparatus of claim 1, wherein a portion of the bill that rests against the forehead is configured to block rain.

11. The apparatus of claim 1, wherein the curved bill comprises an air foil on a leading edge of the curved bill, the air foil configured to generate downward pressure on the curved bill as air passes over the curved bill.

12. The apparatus of claim 1, wherein the bill comprises a single injection molded angled array of air flow channels.

13. The apparatus of claim 1, wherein the varying geometry comprises a plurality of columns of air flow channels arranged between the head covering and a front edge of the bill, wherein a plurality of the air flow channels within one of the plurality of columns have similar geometry.

14. The apparatus of claim 13, wherein the plurality of the air flow channels within one of the plurality of columns proximal to the mediator have an approximately rectangular shape.

15. The apparatus of claim 13, wherein the plurality of the air flow channels within one of the plurality of columns proximal to a side edge of the bill have a polygon shape.

16. The apparatus of claim 1, wherein the varying geometry comprises a plurality of rows of air flow channels concentrically arranged between lateral sides of the bill.

17. An apparatus comprising:

a head covering configured to be worn on a head of a wearer; and a bill attached to the head covering, wherein the bill has a transversal curvature, the bill comprising an array of air flow channels defining a plurality of curved rows, the array of air flow channels being configured to enable air that is flowing from a direction in front or to the side of the head covering to enter into the channels from a bottom of the bill at a first angle relative to a longitudinal axis of the bill and be deflected upward so that the air continues traveling inside the channels through the bill at a second angle relative to the longitudinal axis of the bill until the air exits from the channels at a top of the bill, wherein each of the air flow channels is arranged at a fixed angle relative to the bill to prevent direct light, which is shining onto the top of the bill at a perpendicular angle relative to the bill, from passing through the bill and shining onto the wearer, wherein one of the plurality of curved rows that is proximal to a front edge of the bill comprises a plurality of closed air flow channels that define sealed air pockets that are distributed relative to the transversal curvature to enable the bill to float on water.

18. The apparatus of claim 17, wherein the plurality of closed air flow channels comprises at least one centrally positioned closed air flow channel and a pair of symmetrically distributed closed air flow channels.

19. The apparatus of claim 17, comprising a buoyant material.

20. The apparatus of claim 19, wherein the buoyant material comprises foam or low-density rubberized plastic.

* * * * *